US007980167B2

(12) United States Patent
Schwarzkopf et al.

(10) Patent No.: US 7,980,167 B2
(45) Date of Patent: Jul. 19, 2011

(54) AXIAL PISTON COMPRESSOR

(75) Inventors: Otfried Schwarzkopf, Kuerten (DE); Jens Dittmar, Usingen (DE)

(73) Assignee: Valeo Compressor Europe GmbH, Hockenheim (DE)

( * ) Notice: Subject to any disclaimer, the term of this patent is extended or adjusted under 35 U.S.C. 154(b) by 684 days.

(21) Appl. No.: 11/912,009

(22) PCT Filed: Apr. 3, 2006

(86) PCT No.: PCT/EP2006/003021

§ 371 (c)(1), (2), (4) Date: Jan. 3, 2008

(87) PCT Pub. No.: WO2006/111264

PCT Pub. Date: Oct. 26, 2006

(65) Prior Publication Data

US 2009/0129947 A1 May 21, 2009

(30) Foreign Application Priority Data

Apr. 19, 2005 (DE) ..... 10 2005 018 102

(51) Int. Cl.
*F01B 3/02* (2006.01)

(52) U.S. Cl. ..... 92/12.2

(58) Field of Classification Search ..... 92/12.2
See application file for complete search history.

(56) References Cited

U.S. PATENT DOCUMENTS

| | | | | |
|---|---|---|---|---|
| 4,007,126 A | | 2/1977 | Wheatland | |
| 4,061,443 A | * | 12/1977 | Black et al. | 92/12.2 |
| 4,506,648 A | * | 3/1985 | Roberts | 92/12.2 |
| 4,674,957 A | * | 6/1987 | Ohta et al. | 92/12.2 |
| 5,316,446 A | * | 5/1994 | Kimura et al. | 92/12.2 |
| 5,387,091 A | | 2/1995 | Kawaguchi et al. | |
| 5,540,559 A | | 7/1996 | Kimura et al. | |
| 2004/0007126 A1 | | 1/2004 | Parsch | |

FOREIGN PATENT DOCUMENTS

| | | |
|---|---|---|
| CN | 1509375 | 6/2004 |
| DE | 10152097 | 5/2002 |
| DE | 10315477 | 10/2004 |
| DE | 102004041645 | 3/2006 |
| DE | 102005004840 | 8/2006 |
| EP | 0964997 | 12/1999 |
| FR | 2782126 | 2/2000 |
| JP | 2003269330 | 9/2003 |
| WO | 2002093011 | 11/2002 |

* cited by examiner

*Primary Examiner* — F. Daniel Lopez
(74) *Attorney, Agent, or Firm* — Volpe and Koenig. P.C.

(57) ABSTRACT

Axial piston compressor, especially for motor vehicle air-conditioning systems, having a tilt plate (2), especially a ring-shaped tilt plate, which is variable in terms of its inclination with respect to a drive shaft (1) and which is driven in rotation by the drive shaft (1) and is connected to—especially in articulated connection with—at least one supporting element (5) arranged at a spacing from the drive shaft (1) and rotating together therewith, the pistons in each case having an articulated arrangement with which the tilt plate (2) is in sliding engagement, and the supporting element (5) being arranged at the radially outer end of a force transmission element (6) which rotates together with the drive shaft (1) and is fixed in the latter in an approximately radial direction, wherein the force transmission element (6) is in rotatable and/or radially displaceable articulated connection with the supporting element (5).

23 Claims, 11 Drawing Sheets

Influence of thermal expansion

AXIAL PISTON COMPRESSOR

BACKGROUND

The present invention relates to an axial piston compressor, especially a compressor for motor vehicle air-conditioning systems, in accordance with the preamble of claim 1.

In the field of compressor drive mechanisms, a trend is beginning to emerge that, in the case of compressors having variable piston stroke, increasing use is being made of tilt plates in the form of a tilt ring, that is to say ring-shaped tilt plates, with a tilt-providing articulation necessary for tilting of the plate being substantially integrated into the ring-shaped tilt plate. For example, there is known, from EP 0 964 997 B1, a compressor in which the stroke movement of the pistons is accomplished by means of engagement—in an engagement chamber—of a ring plate oriented on a slant to the machine shaft. The engagement chamber is provided adjacent to the enclosed hollow space of the piston. For sliding engagement that is substantially free from play in any slanting position of the tilt plate or tilt ring there are provided on both sides, between it and the spherically curved inner wall of the engagement chamber, spherical segments, so-called sliding blocks, so that the tilt ring slides between them as it revolves.

The drive is transmitted from the drive shaft to the tilt ring by a pin for conjoint movement which is attached to the drive shaft and the spherical head of which engages in a radial bore in the tilt ring, the position of the head of the member for conjoint movement being selected so that its center-point coincides with that of the spherical segments. In addition, that center-point is located on a circular line which connects the geometric axes of the seven pistons with one another and, moreover, on a circular line which connects the center-points of the spherical articulation members of the pistons. By that means, the upper dead-center position of the pistons is determined and a minimum clearance volume is ensured. The head shape of the free end of the member for conjoint movement makes it possible for the inclination of the tilt plate to change due to the fact that the head of the member for conjoint movement forms a bearing body for a tilting movement of the tilt plate which changes the stroke distance of the pistons.

A further precondition for tilting of the tilt plate is the displaceability of its mounting axis in the direction of the drive shaft. For this purpose, the mounting axis is formed by two mounting pins mounted on the same axis on each side of a sliding sleeve, which mounting pins are additionally mounted in radial bores in the tilt plate. For this purpose, the sliding sleeve preferably has mounting sleeves on each side, which span the annular space between the sliding sleeve and the tilt plate in the manner of spokes.

The limitation on the displaceability of the mounting axis and, as a result, the maximum angled position of the tilt plate results from the pin for conjoint movement, by virtue of the fact that the latter passes through an elongate hole provided in the sliding sleeve so that the sliding sleeve meets end stops at the ends of the elongate hole. The force for the change in the angle of the tilt plate and, therefore, for regulation of the compressor results from the sum of the pressures acting against one another in each case on each side of the pistons, so that this force is dependent on the pressure in the drive mechanism chamber. In accordance with the prior art, the pressure in the drive mechanism chamber can be regulated between a high pressure and a low pressure and consequently affects the balance of forces at the tilt plate, which influences the inclination of the latter. The position of the sliding sleeve can moreover be influenced by springs which, in various variants, are likewise included in the prior art.

Furthermore, the position of the sliding sleeve, which position governs the delivery output, is also determined by the forces of inertia acting on the tilt plate; the position of the tilt plate, that is to say its angle of tilt or slant, changes with increasing speed of rotation. In the case of modern compressors, the trend is towards using tilt plates having moments of inertia such that they bring about a reduction in the stroke distance of the pistons and therefore a reduction in delivery output when the speed of rotation increases.

However, what is problematic in the arrangement explained hereinbefore is the high Hertzian stress in the region of the head of the member for conjoint movement and the tilt plate (system: sphere/cylinder) and the take-up of the (axial) reaction forces due to the gas force on the pistons and the forces due to the torque to be transmitted to the tilt plate.

A compressor similar to the compressor known from EP 0 964 997 B1 is known from JP 2003-269330 AA, although in that compressor a total of two members for conjoint movement are used.

It is important to the kinematics according to the two mentioned publications, that is to say to the kinematics in the case of the subject-matter of EP 0 964 997 B1 and JP 2003-269330 AA, that the head of the member for conjoint movement centrally coincides with the center-point of the sliding blocks of the pistons and that the position of the center-point of the head of the member for conjoint movement is at the same time approximately tangential to the reference circle of the central axes of the pistons.

Added to the afore-mentioned disadvantageous characteristics is the fact that the subject-matter of EP 0 964 997 B1 and of JP 2003-269330 AA has a very complicated structural arrangement, which results in a high number of parts and therefore high cost, and in addition the mounting by means of two members for conjoint movement is over-determined and therefore susceptible to wear, and the strength of the components, especially due to the fact that a hole is introduced into the shaft, has to be regarded as rather low.

A further compressor is known from DE 101 52 097 A1, differing considerably from the subject-matter of the publications discussed hereinbefore. In the case of the subject-matter according to DE 101 52 097 A1, the member for conjoint movement, in particular the spherical head of the member for conjoint movement, is replaced by a hinge pin or spindle. This is, however, integrated into the tilt plate from the outside and fastened using a cup-shaped disc for conjoint movement which is a component of the drive shaft assembly. The subject-matter of DE 101 52 097 A1 also has a complicated structural arrangement; in addition it has to be borne in mind that a large imbalance can come about, depending on the angle of tilt. This promotes wear on the compressor and as a result reduces its service life.

A further compressor is known from FR 278 21 26 A1, which has a member for conjoint movement extending out from the drive shaft radially and engaging in the tilt plate. In similar manner to the solution according to DE 101 52 097 A1, the tilt plate in this arrangement is also fixed to the member for conjoint movement in radial extension. In this there also lies a central difference from the subject-matter of EP 0 964 997 B1 and JP 2003-269330 AA. Whereas in the latter cases the mounting point of the head of the member for conjoint movement in the tilt plate undergoes relative movement in the guideway (bore) in the tilt plate because the tilt plate performs the rotary movement in an articulation lying on the shaft axis, the rotary movement in the case of the arrangements according to FR 278 21 26 A1 and DE 101 52 097 A1 is accomplished in the lateral articulation of the tilt plate.

In the unpublished Patent Application DE 102 00 404 1645 belonging to the present Applicant, there is proposed a member for conjoint movement which is displaceably mounted in the shaft. As a result, the transmission of force between the head of the member for conjoint movement and the tilt plate can be accomplished optimally (force transmission as a result of area-wise contact). However, the displacement of the member for conjoint movement in the shaft can be problematic because high forces have to be taken up there due to the bending moment and the parts therefore have to be of very rigid construction. This rigid construction causes the compressor to have an increased mass.

From DE 103 154 77 A1 there is known a compressor of the tilt plate/member for conjoint movement construction type wherein the member for conjoint movement does not transmit any torque. This feature in addition also applies to preferred arrangements of DE 102 00 404 1645. The conjoint movement function is restricted to providing support for the piston forces acting axially on the tilt plate, the torque being delivered by further force transmission elements independent of the member for conjoint movement. As a result, the forces acting on the member for conjoint movement are lower because, as already mentioned, no torque is transmitted. The advantage of this approach lies in the fact that the forces or surface contact pressure due to the forces applied (because of the fact that these forces are relatively low) do not cause any excessive deformation at and in the member for conjoint movement, as a result of which the member for conjoint movement can be of correspondingly lightweight construction and tilting of the tilt plate can be accomplished in a relatively hysteresis-free manner. However, a disadvantageous effect can be that the spherical head of the member for conjoint movement is located in a relatively large recess in the tilt plate. As a result, the Hertzian stress can or must be described by a plane/sphere geometric pairing, which is relatively disadvantageous because it causes a high degree of Hertzian stress.

Finally, from the likewise unpublished DE 10 2005 004 840 belonging to the present Applicant, there is known a compressor which provides an improvement in respect of the problem of surface contact pressure. The subject-matter of DE 10 2005 004 840 includes a support element in engagement with a tilt ring, with line contact arising between the support element and the tilt ring. Compared to the previously described prior art, this constitutes an improvement in respect of the Hertzian stress. A likewise advantageous effect is that, in the case of the subject-matter of DE 10 2005 004 840, a drive moment and a torsional moment are decoupled from the gas force support. However, a relatively large recess is necessary in the tilt plate in order to ensure thereby a sufficient length of line contact and to achieve correspondingly low surface contact pressure. The large recess in the tilt plate could, because of the gas forces to be transferred, result in deformation of the tilt ring and therefore in wear. Furthermore, the down-regulating behaviour of the tilt plate (which is dependent on the moment of deviation relative to the tilt-providing articulation) and also the imbalance thereof are disadvantageously affected by a large recess. In the case of the subject-matter of DE 10 2005 004 840 the mass of the gas force support does not affect the moment of deviation.

SUMMARY

Starting from the prior art explained hereinbefore, the object of the present invention is to provide a compressor whose supporting element can take up forces over as large an area as possible (which corresponds to low Hertzian stress), whilst an imbalance of the tilt plate due to the mounting and tilting thereof and of further parts associated with the mass-related properties of the tilt plate is low over the entire tilt angle range and the entire speed of rotation range.

The objective is met by a compressor having the features according to patent claim 1.

A fundamental point of the invention accordingly is that a force transmission element is in rotatable and/or radially displaceable articulated connection with the supporting element. The articulated connection of the supporting element with the force transmission element ensures that the supporting element can take up forces over a large area, in which case the mass-related properties of the tilt plate are optimised because a constructional measure of such a kind can have a positive effect on the mass-related properties (in models, the mass of the supporting element can be added to that of the tilt plate).

The force transmission element can be non-rotatably and/or radially non-displaceably connected to the drive shaft, which ensures that a compressor according to the invention has a simple structure. Depending on the constructional implementation of the required degrees of freedom, the force transmission element can also of course be rotatably mounted in the drive shaft.

In a preferred arrangement, both the force transmission element and the supporting element are in the form of cylindrical pins. Such a structure is, on the one hand, simple to achieve in constructional and manufacturing terms and ensures, especially as a result of the cylindrical-pin-shaped structure of the supporting element, a low degree of Hertzian stress between the supporting element and the tilt plate.

In a constructionally simple arrangement, the supporting element and the force transmission element form an approximately T-shaped gas force support means.

The supporting element optionally has a recess, in which the force transmission element engages. This recess is preferably a bore, thereby ensuring a simple and economical structure for a compressor according to the invention.

The supporting element can furthermore be mounted in a cylindrical recess, especially a bore, in the tilt plate. The bore in that case extends perpendicular to the drive shaft axis. This too relates to a constructionally simple and therefore preferred arrangement of a compressor according to the invention.

Preferably, the supporting element and the force transmission element serve substantially only for providing the pistons with axial support or, that is to say, for support for the gas force, whereas an arrangement independent thereof, especially an articulated connection, between the drive shaft and the tilt plate serves substantially only for torque transfer. This ensures decoupling of the drive torque and gas force support.

In a further preferred embodiment, the force transmission element is rotatably mounted in the drive shaft whereas the supporting element is in non-rotatable engagement with the force transmission element. The force transmission element optionally is a pin having an at least partly approximately circular or semi-elliptical cross-section.

In the case of a compressor according to the invention, preference is given to the tilt plate being pivotally mounted on a sliding sleeve mounted so as to be axially displaceable along the drive shaft, the tilt plate being connected by way of drive pins to the sliding sleeve and/or to the drive shaft. This ensures simple implementation of the decoupling of drive torque and gas force support. The drive pins can be introduced into the sliding sleeve or the tilt plate with a press fit or secured therein by axial securing elements. Preferably, the drive pins project into a recess, which can especially be in the form of a groove, in the drive shaft. A connecting element, especially in the form of a feather key, arranged between the drive shaft and the sliding sleeve, which connecting element allows transfer of forces and moments in a radial direction and which is mounted in axially displaceable manner on the drive shaft, is optional. That end of the force transmission element which is remote from the supporting element can project through the drive shaft and into a longitudinal slot in the sliding sleeve in such a way that drive torque is transferred from the drive shaft to the sliding sleeve by that end of the force transmission element which is remote from the supporting element. The above-mentioned constructional features ensure reliable decoupling of drive torque and gas force support.

Regions of the recess in the tilt plate—which recess can especially be in the form of a bore—which are not filled by the supporting element are preferably filled by a compensating weight, especially in the form of a closure element, or by compensating weights, especially in the form of closure elements. As a result, the kinematic properties of the tilt plate can be optimised so that it is possible to provide an action in the direction of an increasingly down-regulating tendency of the compressor at an increasing speed of rotation.

For reliable transfer of the torsional torque, an arrangement, especially at least one cylindrical-pin-like element, or supporting and/or contact surfaces can be provided between the sliding sleeve and the tilt plate to provide support in relation to a torsional moment applied in the region of the drive shaft.

The force transmission element, especially the longitudinal axis thereof, is optionally arranged offset relative to the torque axis, especially the axis of the drive shaft. In that case the supporting element and/or the force transmission element can be formed of a plurality of parts. The force transmission element can furthermore be of angled shape; it can especially have one portion extending perpendicular to the tilt moment axis and one portion extending through that axis. Alternatively or also, however, additionally, the force transmission element can be arranged eccentrically in the drive shaft. As a result of the above-described constructional measures, the transfer of the torsional moment is reduced and disadvantages such as additional friction, jamming or hysteresis are avoided.

The tilt plate can be made of steel, brass or bronze. Also feasible, furthermore, is a multi-component and/or multi-material tilt plate which includes combinations of the aforementioned materials. All of the afore-mentioned materials provide good strength and rigidity for the constructional arrangement of the tilt plate. The relatively high density of the materials, especially of bronze or brass, results in an advantageous mass distribution so that the translational moments of the piston masses can be optimally compensated by the rotational moments of the tilt plate. Especially, but not solely, in the case where the tilt plate is made of steel, the tilt plate can have a low-wear coating, which results in a long service life for a compressor according to the invention.

In a preferred arrangement, the pistons are made of aluminium or an aluminium alloy, as a result of which the weight of a corresponding compressor can be kept low. Alternatively, the pistons can also be made of steel or a steel alloy, which results in their having high strength, a material selection that is suited to the material of the tilt plate (similar thermal expansion coefficients) being advantageous.

In a further advantageous embodiment, the supporting element is barrel-shaped or cigar-shaped or cylindrical, the cylinder having a diameter that becomes narrower from the middle of the cylinder towards the ends of the cylinder (in the axial direction). This is also the case, analogously, for the barrel shape or cigar shape. As a result, it can be ensured that there is only line contact between the supporting element and the tilt plate and accordingly the possibility of jamming between the two components can be ruled out. Line contact is also suitable for force transfer especially in the case of a tilt plate made of steel so that the above-described arrangement is feasible and advantageous both in combination with drive pins for torque transfer and also without them, that is to say therefore in a case where force transfer occurs by way of the force transmission element and the supporting element.

BRIEF DESCRIPTION OF THE DRAWINGS

The invention will be described hereinbelow with regard to further advantages and features by way of example and with reference to the accompanying drawings, in which.

DETAILED DESCRIPTION OF THE PREFERRED EMBODIMENTS

Figure 1:
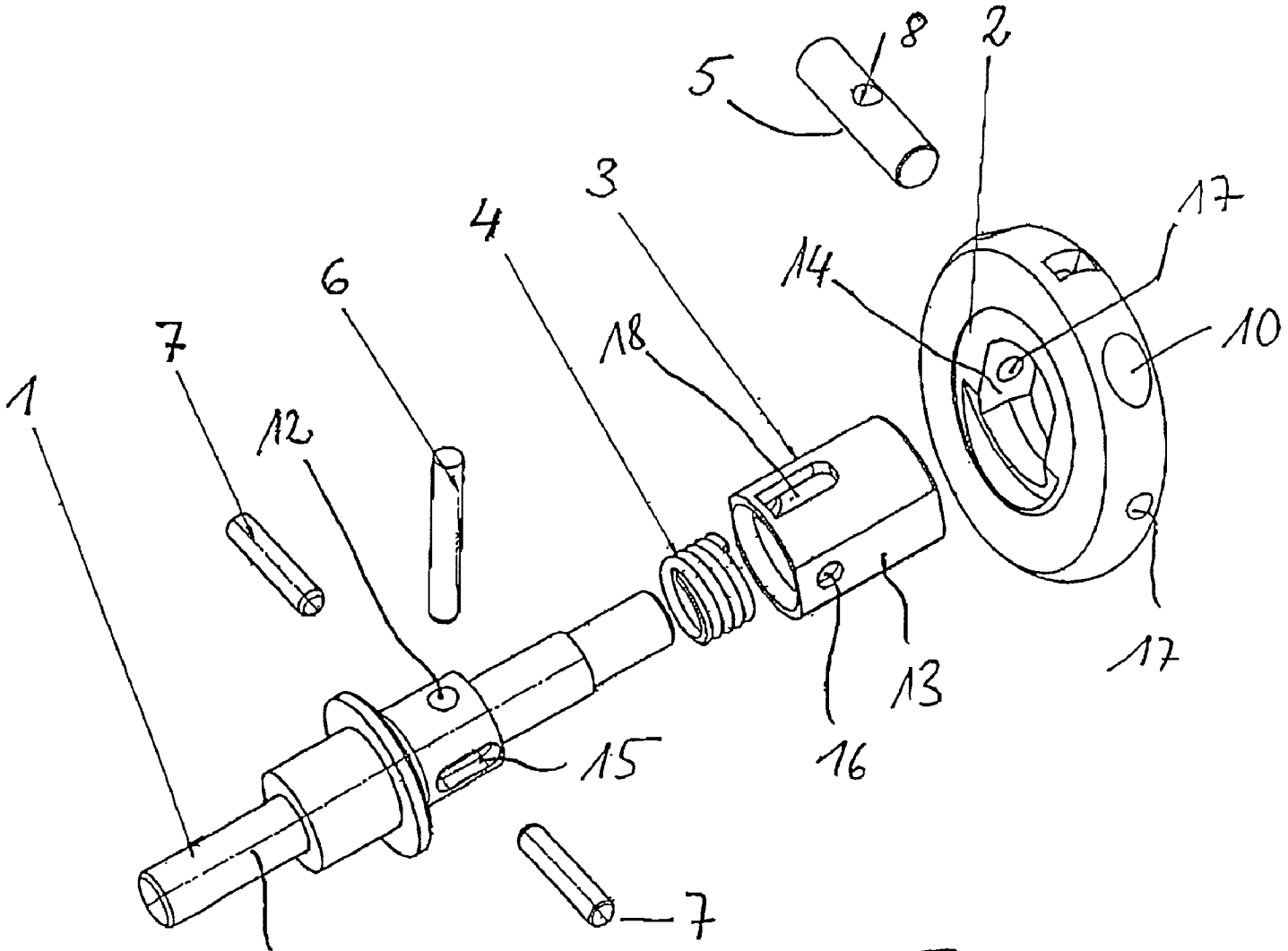
FIG. 1 shows, in an exploded view, a tilt plate mechanism of a first preferred arrangement of a compressor according to the invention.

All preferred arrangements of a compressor according to the invention comprise (not shown in the drawings) a housing, a cylinder block and a cylinder head. Pistons are mounted in the cylinder block so as to be movable back and forth axially. The compressor drive is provided via a belt pulley by means of a drive shaft 1. The compressors in the present case are compressors having variable piston stroke, the piston stroke being regulated by the pressure difference defined by the pressures on the gas inlet side and in the drive mechanism chamber. Depending on the magnitude of the pressure difference, a tilt plate in the form of a tilt ring 2 is deflected, or tilted, from its vertical position to a greater or lesser degree. The greater the resulting angle of tilt, the greater is the piston stroke and, therefore, the higher is the pressure made available on the outlet side of the compressor.

From FIG. 1 it can be seen that the tilt plate mechanism of a first preferred arrangement of a compressor according to the invention comprises: the tilt ring 2; a sliding sleeve 3, which is mounted so as to be axially displaceable on the drive shaft 1; a spring 4; a supporting element 5; a force transmission element 6; and drive pins 7, which serve for transmitting torque between the drive shaft 1 and the tilt ring 2.

The supporting element 5 is in rotatable and radially displaceable articulated connection with the force transmission element 6, whereas the force transmission element 6 is non-rotatably and radially non-displaceably connected to the drive shaft 1. Both the supporting element 5 and the force transmission element 6 are cylindrical-pin-shaped. As already mentioned, the supporting element 5 is in rotatable and radially displaceable articulated connection with the force transmission element 6, which is accomplished by way of a recess 8 in the supporting element 5, in which recess the force transmission element 6 engages. This recess 8 is in the form of a bore in the supporting element 5. In the assembled state, the supporting element 5 and the force transmission element 6 form an approximately T-shaped gas force support means 9 (cf., for example, FIG. 3). The supporting element 5 is mounted in a cylindrical recess 10—which in the first preferred arrangement being described here is in the form of a bore—in the tilt ring 2. The bore 10 extends perpendicular to the drive shaft axis 11. The non-rotatable and radially non-displaceable mounting of the force transmission element 6 in the drive shaft 1 is accomplished by a recess 12 in the drive shaft 1, into which the force transmission element 6 is introduced with a press fit.

The sliding sleeve 3 has two flattened sides 13 (only one flattened side can be seen in FIG. 1), which are in sliding engagement with corresponding flattened regions 14 on the tilt ring 2. As already indicated by the terminology selected, the gas force support means 9—which as mentioned hereinbefore comprises the force transmission element 6 and also the supporting element 5—serves substantially only for providing axial support for the piston forces, whereas the transmission of torque to the tilt plate is accomplished substantially by the drive pins 7. In addition to a connection between the tilt ring 2 and the drive shaft 1, the drive pins 7 also provide a connection between the sliding sleeve 3 and the drive shaft 1 and resultant force/torque transmission. The drive pins 7 project into a recess in the drive shaft in the form of grooves 15 (again, only one of the grooves 15 can be seen in FIG. 1). The drive pins 7 are introduced into corresponding recesses 17 in the tilt ring 2 with a press fit. It should be mentioned at this point that the drive pins 7 can also be introduced with a press fit into the sliding sleeve 3 as an alternative to being introduced into the tilt ring 2 with a press fit.

The spring 4 serves as a connection element which is arranged between the drive shaft 1 and the sliding sleeve 3 and which allows forces to be transmitted in the axial direction. It is mounted so as to be axially displaceable on the drive shaft 1. The end of the force transmission element 6 which is remote from the supporting element 5 projects through a longitudinal slot 18 formed in the sliding sleeve 3 and into the drive shaft 1. At this point it should be noted that, as an alternative to or also in addition to force/torque transmission by way of the drive pins 7, the sliding sleeve can be so constructed that a longitudinal slot arranged opposite the longitudinal slot 18 is provided in the sliding sleeve, into which slot that end of the force transmission element 6 which is remote from the supporting element 5 projects, consequently transferring drive torque from the drive shaft 1 to the sliding sleeve 3. It should again be briefly mentioned at this point that the drive shaft 1 and the sliding sleeve 3 can, in addition to or as an alternative to the connection and/or torque transmission by way of the drive pins 7, have flattened regions that correspond to one another so that the sliding sleeve is mounted on the drive shaft for conjoint rotation therewith (not shown in FIG. 1).

Figure 2:
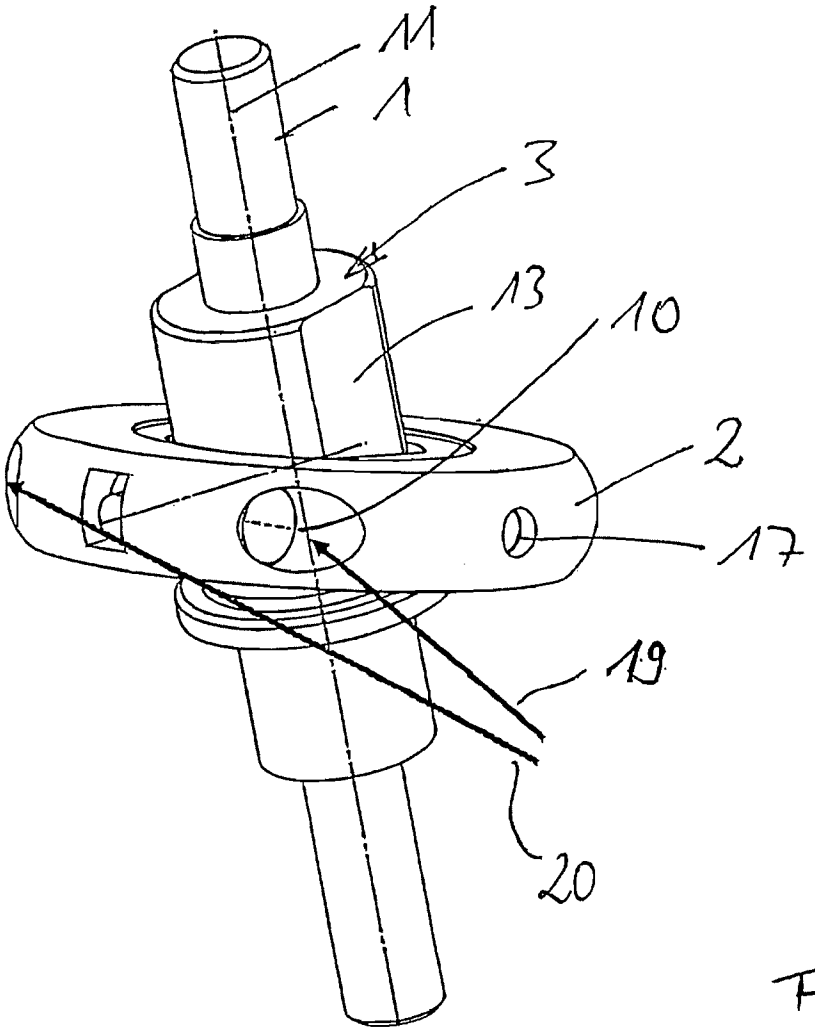
FIG. 2 shows, in a perspective view, the tilt plate mechanism according to FIG. 1 in the assembled state.

The arrangement shown in an exploded view in FIG. 1 is shown in the assembled state in FIG. 2. From FIG. 2, it can be seen that the supporting element 5 does not completely fill the bore 10 in the tilt ring 2. Those regions which are indicated by arrows 19, 20 and which are not filled by the supporting element 5 are closed off (not shown in FIG. 2) by, and substantially filled by, a compensating weight in the form of a closure element. Through this, the kinematics of the tilt ring 2 can be optimised so that the desired regulation behaviour is obtained or reinforced, which usually means in the case of compressors of modern construction that the compressor has an increasingly down-regulating tendency for an increasing speed of rotation.

Figure 3:
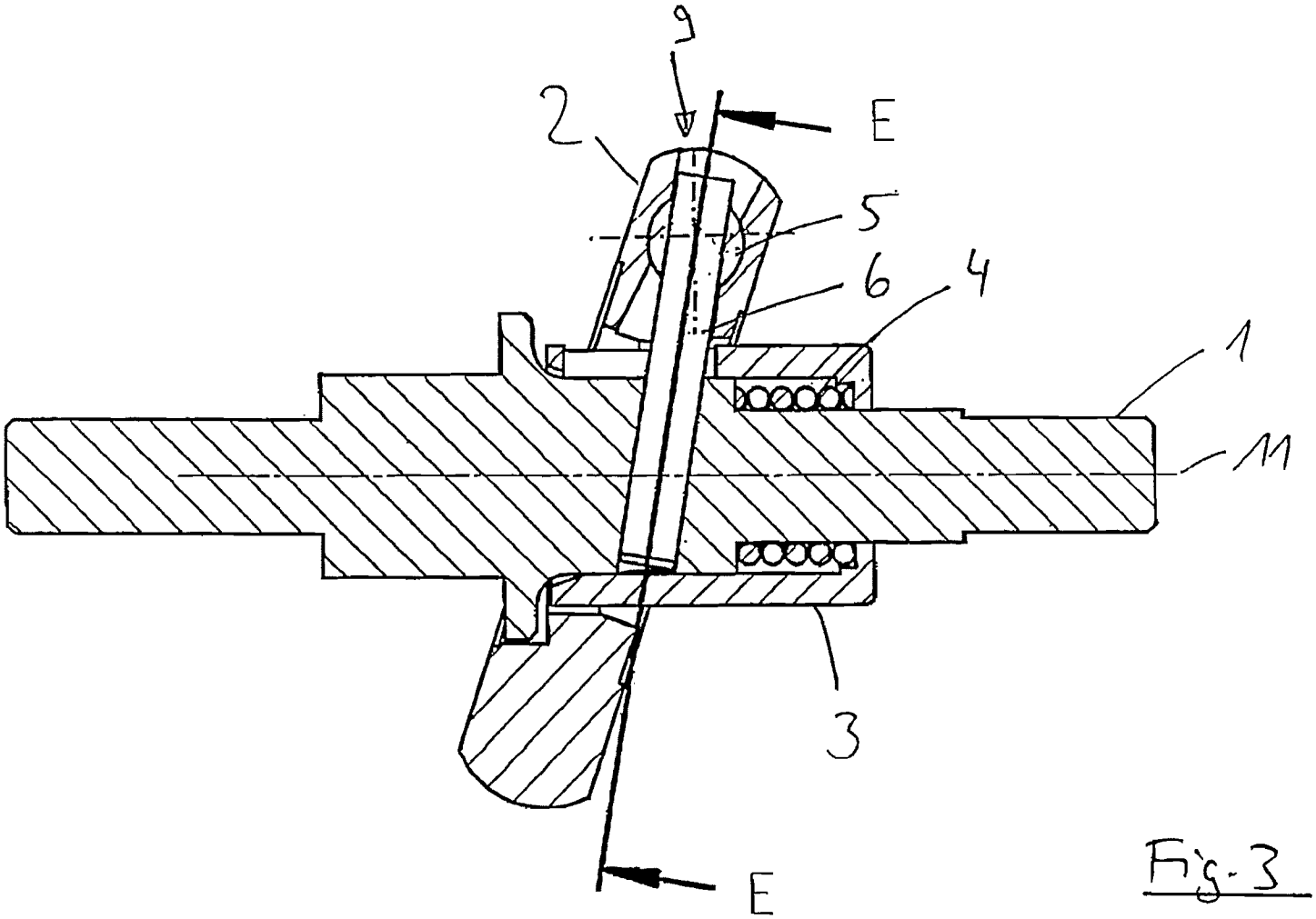
FIG. 3 shows, in a longitudinal section view, the tilt plate mechanism according to FIG. 1 at a maximum tilt angle of the tilt plate.
Figure 4:
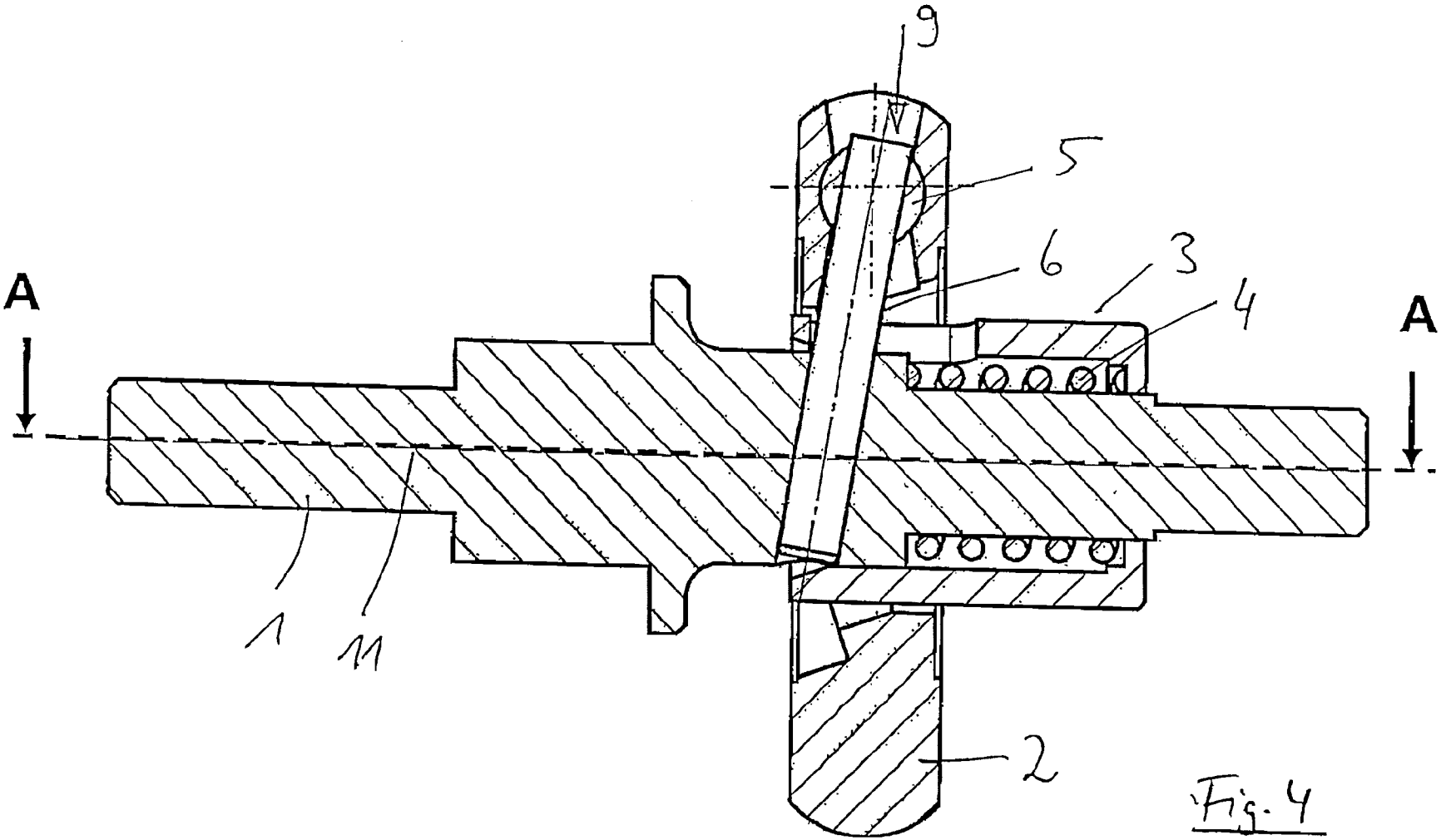
FIG. 4 shows, also in a longitudinal section view, the tilt plate mechanism according to FIG. 1 at a minimum tilt angle of the tilt plate.
Figure 5:
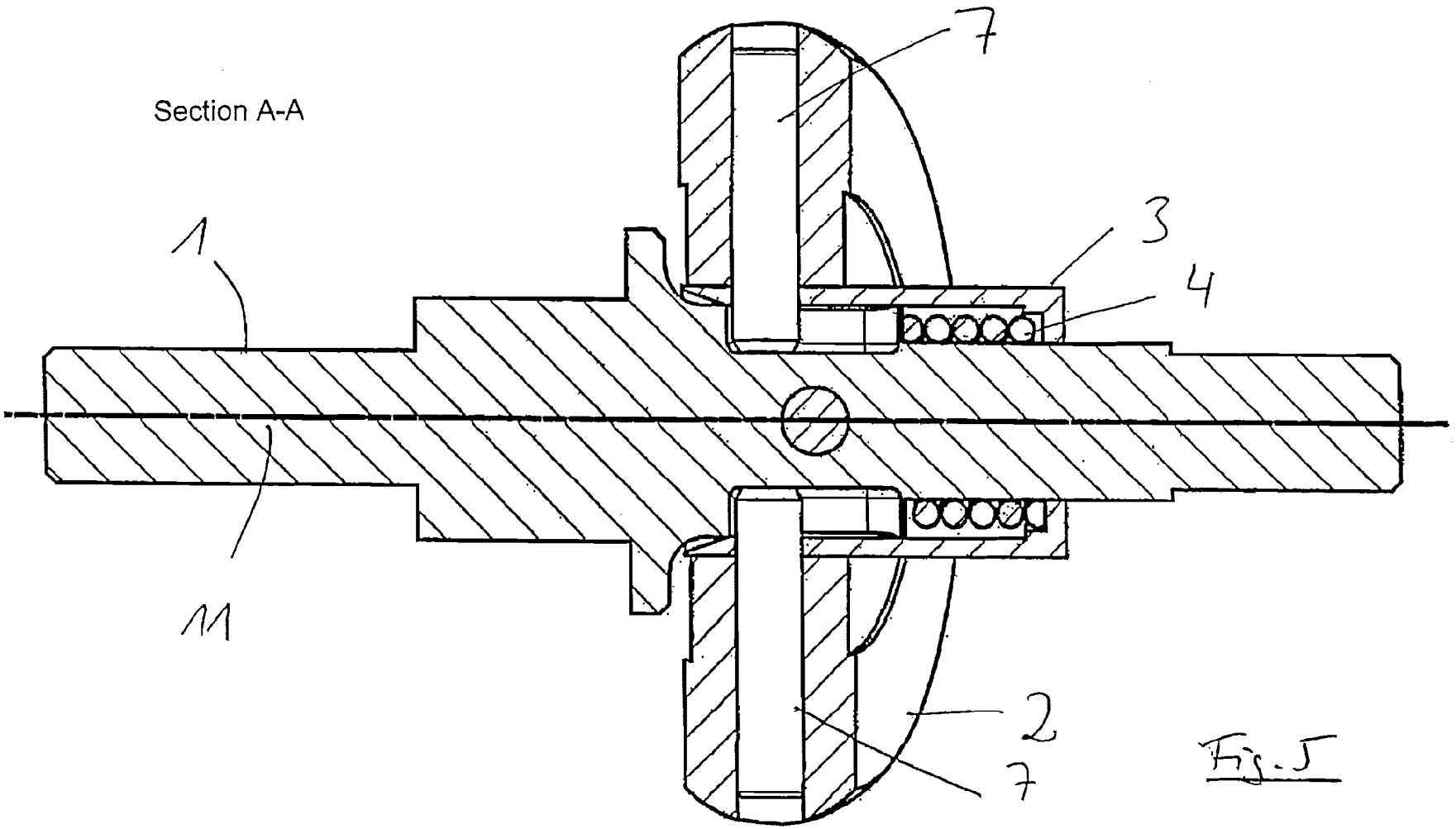
FIG. 5 shows the tilt plate mechanism according to FIG. 4 in a sectional view along the plane A-A.

In FIGS. 3 and 4, in which the tilt plate mechanism according to FIGS. 1 and 2 is shown again in a sectional view (at a maximum tilt plate deflection angle in FIG. 3 and at a minimum tilt plate deflection angle in FIG. 4), there can especially be seen the interplay between the sliding sleeve 3, the spring 4 and the tilt ring 2 and also the gas force support means 9. At a maximum deflection angle of the tilt ring 2, the spring 4 is in a compressed state, whereas for a minimum deflection angle of the tilt ring 2 the spring is in a relaxed state. FIG. 5 furthermore shows a section along the plane A-A of FIG. 4, FIG. 5 especially showing the interplay of the drive pins 7 and the tilt ring 2.

Figure 6B:
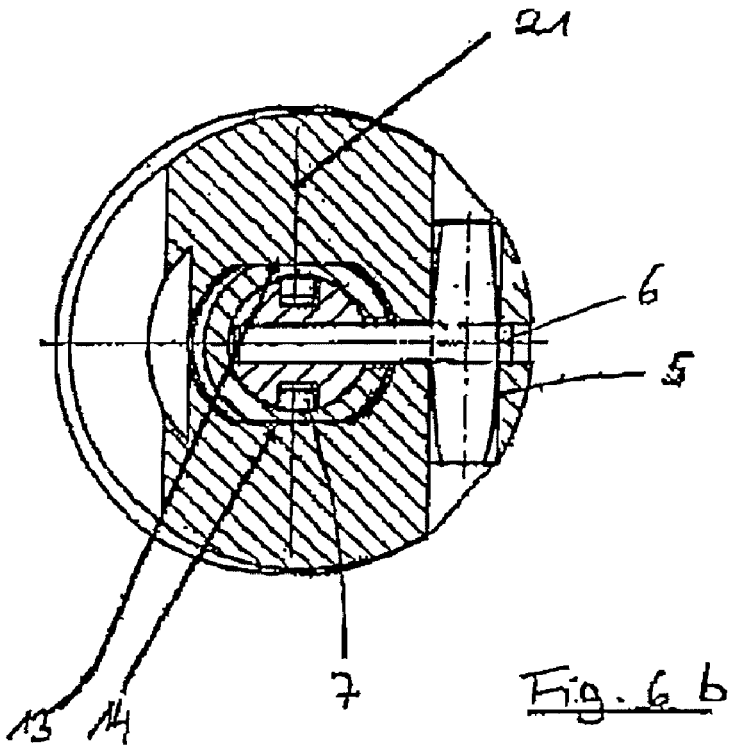
FIG. 6*b* shows an alternative arrangement of a tilt plate mechanism in a view corresponding to FIG. 6*a;*
Figure 6A:
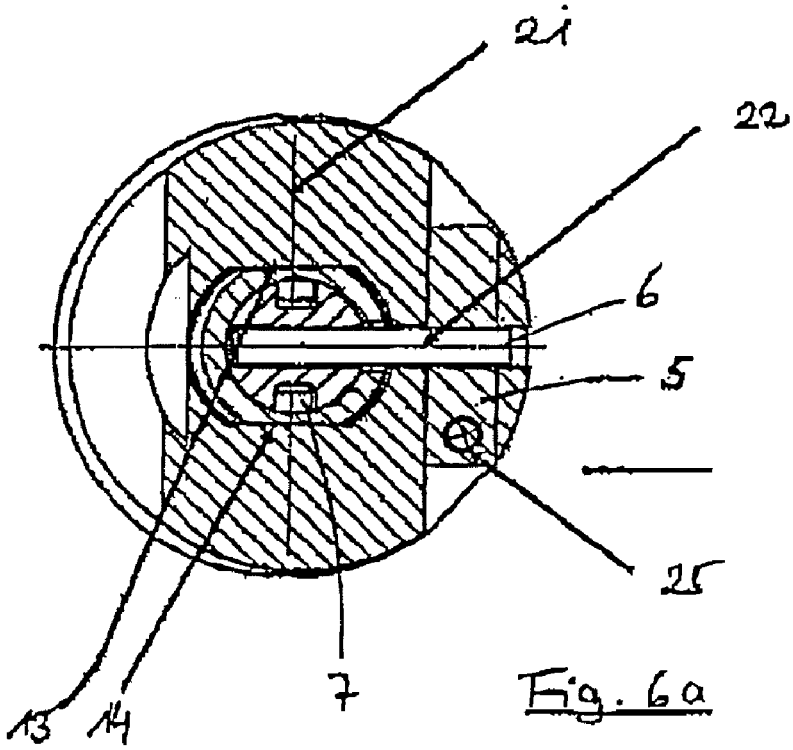
FIG. 6*a* shows the tilt plate mechanism according to FIG. 3 in a sectional view along the sectional plane E-E.

FIG. 6*a* shows a section along the plane E-E of FIG. 3. Because the cylindrical-pin-shaped or barrel-shaped contour of the supporting element 5 extends perpendicular to the plane of torsional moment (indicated by the torsional moment axis 22) to a degree which is not negligible, a torsional moment (which acts perpendicular to the tilt moment of the tilt ring and which is brought about inter alia because the maximum gas force at a piston occurs at the moment of opening of the valve and not in the dead-center of the piston) can be introduced there, that is to say at the cylindrical supporting element 5, unless the latter is mounted in the force transmission element 6 so as to be rotatable about its central axis in a manner in accordance with the invention. For that reason, an arrangement according to the invention ensures that the torsional moment (twisting) is introduced only into the elements provided for the purpose, which can be, for example, the spindle-like drive pins 7 or else any desired supporting surfaces. The possibility of introduction of the torsional moment into the force transmission element 6 is ruled out by an arrangement according to the invention. Reference numeral 22 denotes the axis of the torsional moment (cf. FIG. 6*a*).

An alternative arrangement is shown in FIG. 6*b* in a view analogous to FIG. 6*a*. In this alternative arrangement, the supporting element 5 has a cigar-shaped outline, that is to say the supporting element 5 is shaped like a cylinder which has its largest diameter in the middle of the cylinder and whose diameter then decreases in the direction of both ends of the cylinder. As a result, a separation of the drive function and the gas force supporting function is achieved, because there is no area-wise contact between the supporting element 5 and the tilt ring 2. It should, however, be noted at this point that, in the context of the present invention, there are provided both compressors wherein, as a result of the nature of the mounting of the supporting element 5 and of the force transmission element 6, the drive torque can be transferred from the shaft to the tilt ring in its entirety or in part and also compressors wherein the transfer of the drive torque is substantially performed not by the supporting element 5 and the force transmission element 6 but rather, as described hereinbefore, by the drive pins 7. Especially for a tilt ring or tilt plate of steel, line contact should be sufficient to be able to transfer torques. It should be noted at this point that the formation of the barrel shape can be highly cambered as in FIG. 6*b*, although a type of crowning in the micrometer range is also feasible.

Since the subject of the material from which the tilt ring 2 is made was brought up hereinabove, it should be noted at this point that the tilt ring 2, which in the above-described arrangement is made of steel and provided with a coating which minimizes wear and friction between the sliding blocks of the pistons and the tilt ring 2, can also, as an alternative, be made of brass or bronze. The mentioned materials ensure that the requirements caused by this construction type can be met. The tilt rings 2 used are in fact rings whose height dimension is much greater than in the prior art. The height is desirable, on the one hand, so that the gas force support means, which is comprised of the supporting element 5 and the force transmission element 6, can be mounted therein; on the other hand, the height is advantageous in order to provide the component with sufficient inertia of mass. This is necessary in order to be able to produce a tilting moment based on the gyroscopic effect on rotation of the tilt ring 2, which moment is large enough to be able to compensate or over-compensate to the desired extent the oppositely acting tilting moments due to the mass forces of the pistons.

For tilt rings 2 of such a kind, the mentioned materials such as steel, brass or bronze are especially advantageous because, by virtue of the height of the tilt ring 2, these materials provide sufficient strength and rigidity to be able to prevent deformation. In the case of tilt rings according to the prior art, this is frequently not ensured. Furthermore, the density of bronze or brass is, depending on the alloy, possibly somewhat greater than the density of steel or of grey cast iron (a tilt ring 2 according to the invention can of course also be made of grey cast iron). The density increase or, that is to say, the higher density of bronze or brass can be utilised in order to be able to compensate or over-compensate the piston masses even better. The height of the tilt ring 2 results in the fact that the pistons, which in the application under discussion here engage around the tilt ring 2 and are mounted thereon using two sliding blocks, must have a large opening for engaging around the tilt ring 2.

In the preferred arrangement in which the tilt ring 2 is made of brass, the pistons are made of an aluminium alloy. Because brass has thermal expansion that is similar to aluminium, a material combination of such a kind provides for reduced wear and an extended service life of a compressor according to the invention because the play of the sliding blocks in the pistons increases only insubstantially or not at all compared to the state on assembly. This results in a low degree of noise formation and precludes the possibility that sliding blocks may drop out because of excessive play. If the tilt ring 2 is made of steel, pistons which are also made of steel accordingly offer the same advantages. Alternatively, however, other material combinations (especially under the aspect of reducing the weight of a compressor according to the invention) are also feasible.

Figure 11:
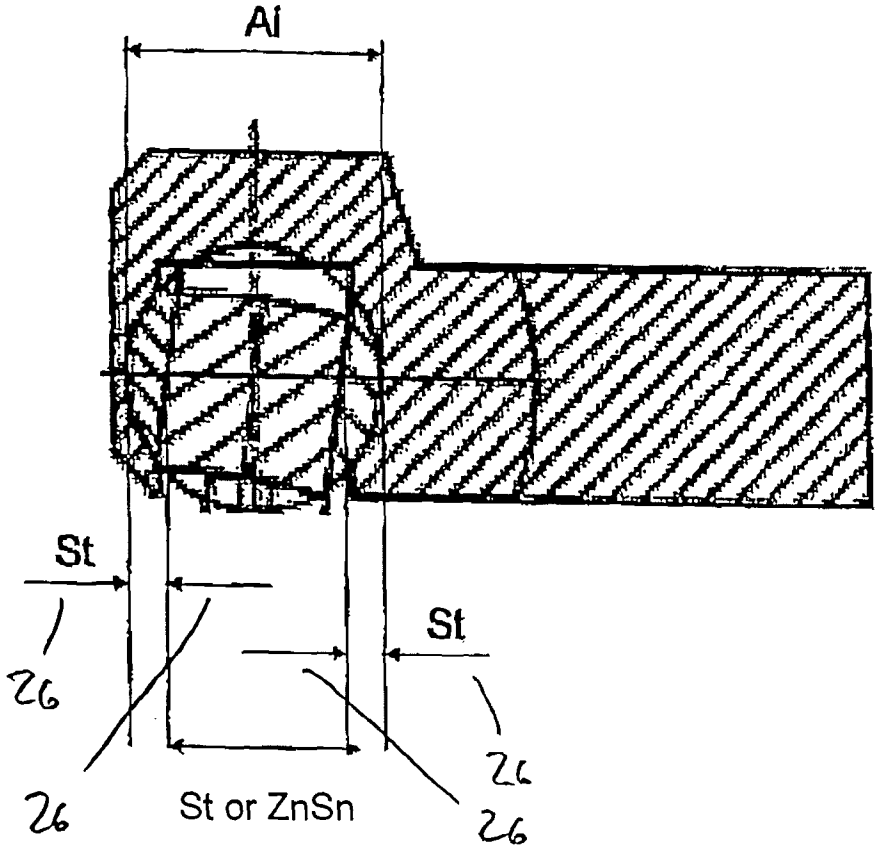
FIG. 11 is a view illustrating the differences that occur depending upon the material of the tilt ring due to linear thermal expansion.

In order to illustrate the differences that occur depending on the material of the tilt ring 2 (that is to say whether the tilt ring 2 is made of steel or brass), reference is made to FIG. 11, where the differences in the linear thermal expansion between steel and brass are indicated by arrows 26.

At this point, brief details of the advantages of the invention should again be given, which are as follows: the gas force support means 9 assumes to a large extent and preferably without torque (provided that an arrangement is selected in which the force transmission element 6 is not, at its end remote from the supporting element 5, in torque-transferring engagement with the sliding sleeve 3) the support function of the tilt ring 2 with regard to the axially acting piston forces; the supporting element 5 is of large area, that is to say cylindrical-pin-shaped or barrel-shaped, in which case torsional moments cannot be introduced because the gas force support means 9 can align itself about its central axis either at the transition between the force transmission element 6 and the supporting element 5 or (as will be described further hereinbelow) by rotatable mounting of the force transmission element in the drive shaft 1; the drive moments are transferred in a defined manner in the plane perpendicular to the tilting plane of the tilt ring, although it should be noted here that there are various possibilities for force transfer and/or torque transfer. As a result of the fact that the supporting element 5 is in both rotatable and radially displaceable articulated connection with the force transmission element 6, substantially no torsional moment (torsion) can be transferred. This makes it possible for the torsional moment to be transferred in defined manner elsewhere, as has already been mentioned hereinbefore, and prevents jamming of the mechanism. Simple and rapid assembly is also ensured as a result. Over-determination in respect of the torsional moment, which could be produced if the supporting element 5 is cylindrically formed, is avoided as a result of the rotatable mounting thereof, for example on the force transmission element 6.

Further details of transfer of the drive torque will be given below: as already mentioned in the description of FIG. 1, the tilt ring 2 is connected by way of the drive pins 7 to the sliding sleeve 3 and to the drive shaft 1. The sliding sleeve 3 is mounted on the drive shaft 1 so as to be axially displaceable and, in interplay with the spring 4, the drive pins 7 and the gas force support means 9, allows the tilt angle of the tilt ring 2 to adjust itself. The tilt angle established on adjustment is dependent on the gas forces, on the inertia properties of the tilt ring 2 and on the pistons in engagement with the latter and also on the spring force of the spring 4. The sum of the moments about the tilt axis 21 is, in other words, zero (tilt moments equal to zero). The drive pins 7 are secured against dropping out axially, which is accomplished by introducing the pins into the sliding sleeve 3 or tilt ring 2 with a press fit. The transfer of the drive torque is accomplished in the present preferred arrangement directly from the drive shaft 1 to the tilt ring 2 by way of the drive pins 7. Alternatively it is feasible for the drive torque to be transferred indirectly by way of the sliding sleeve 3. In both cases, however, there are elements (for example, drive pins 7) which are connected to or project into the shaft 1. Of course it is also feasible for there to be just one element. As a result, the radial orientation of the sliding sleeve 3 is defined and a sufficiently large recess in the sliding sleeve ensures that that part of the gas force support means 9 which faces the supporting element 5 or, that it to say, the force transmission element 6 cannot transfer a moment to the sliding sleeve 3. FIG. 1 shows how the drive pins 7, which are connected to the tilt ring 2, project into a groove 15 in the drive shaft 1. As a result, the drive torque is transferred directly by the drive pins 7 from the drive shaft 1 to the tilt ring 2.

Alternatively, indirect transfer of the drive torque with a force path by way of the sliding sleeve 3 is feasible. In constructional terms this could be put into practice as follows: a connecting element between the drive shaft 1 and the sliding sleeve 3, which connecting element allows the transfer of forces and/or moments in a radial direction but allows the axial displacement of the bushing, for example by sliding in a groove in the sliding sleeve 3. Such a connecting element could be, for example, a feather key. The end of the force transmission element 6 which is opposite the supporting element 5 is passed through the shaft and projects into a slot in the sliding sleeve 3, in which slot the force transmission element 6 is closely guided and as a result the drive torque can be transferred. Flattened regions on the sliding sleeve 3 and the tilt ring 2 then transfer the moment to the tilt ring 2.

A central point of the present invention is the formation of the gas force support means 9. In the context of the present invention a gas force support means 9 is provided which on the one hand is relieved of loading as a result of its not transferring drive torque but which on the other hand is optimised with respect to surface contact pressure resulting from transfer of the gas forces.

Figure 7:
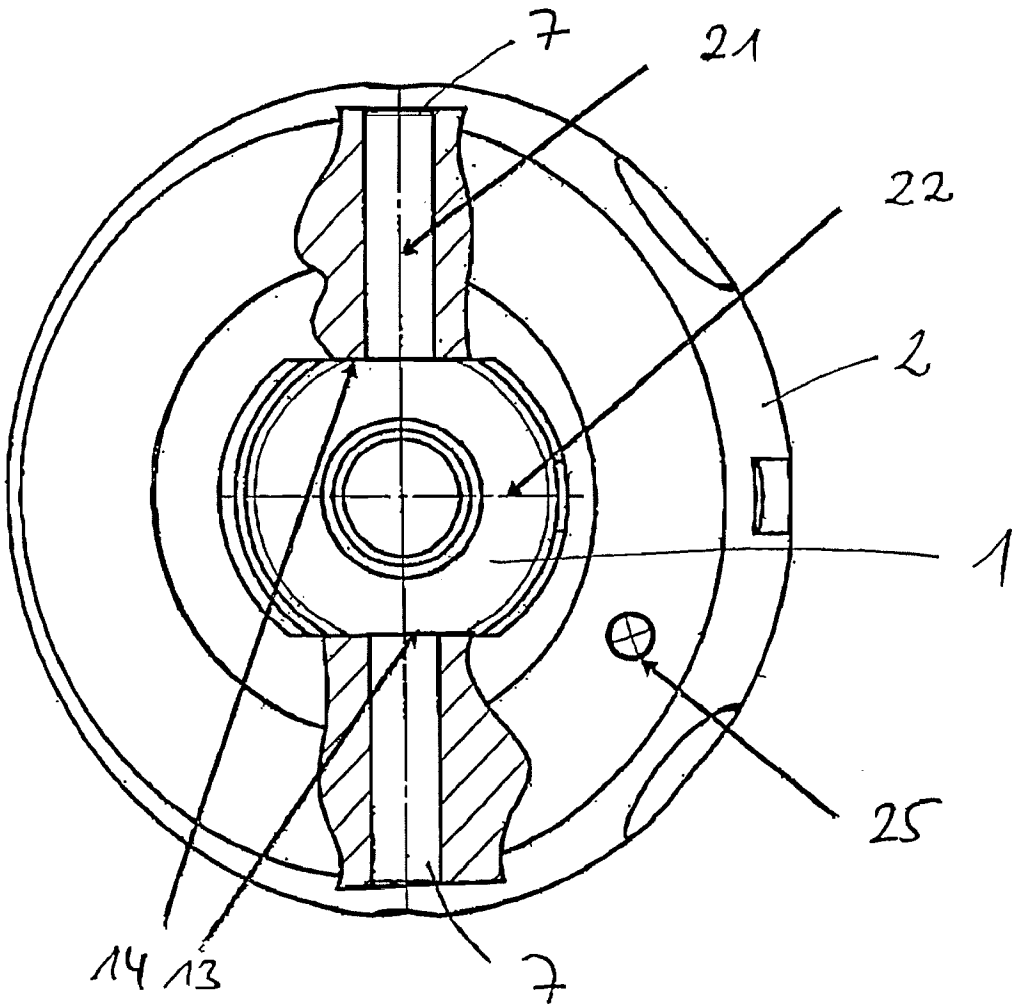
FIG. 7 shows, in a top view partly in section, the first preferred arrangement.

Furthermore, attention is drawn again at this point to the corresponding flattened regions 13, 14 on the drive shaft 1 and the sliding sleeve 3, which can be seen very well in FIG. 6. The flattened regions can also be seen in FIG. 7, which again shows the first preferred arrangement of a compressor according to the invention, in a partly sectional view. The interplay between the drive pins 7 and the tilt ring 2 can also be seen here.

Figure 8A:
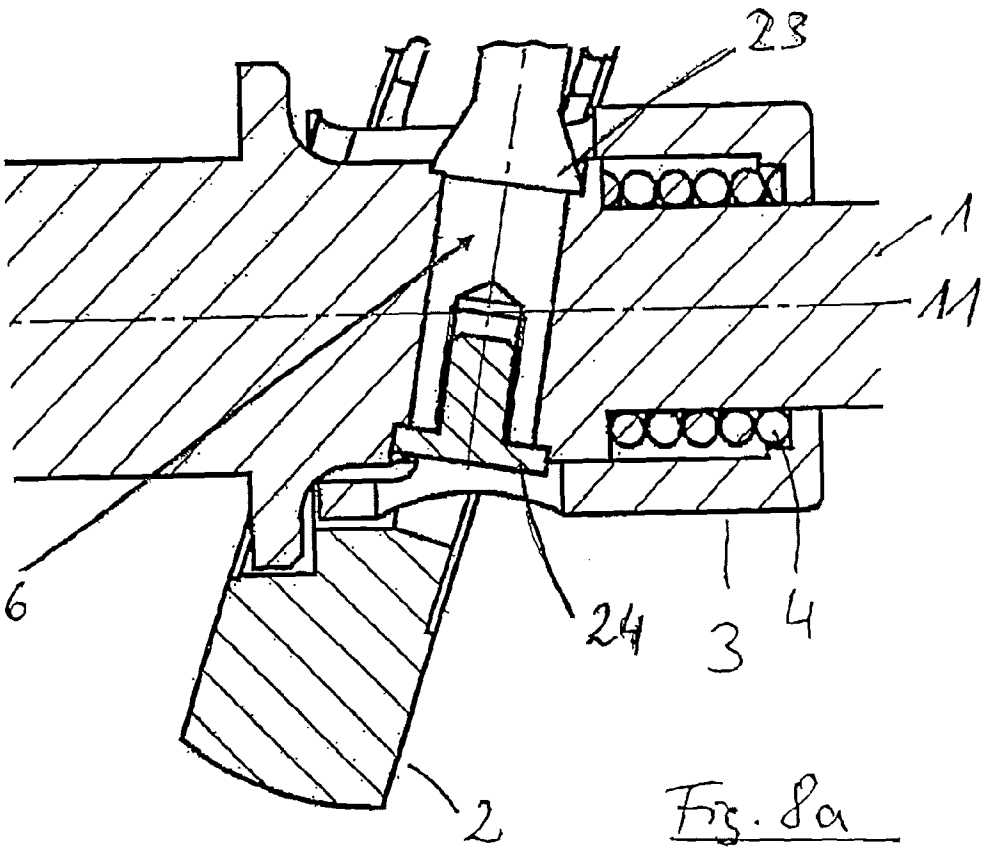
FIGS. 8*a*+8*b* show, in a partial view, a second preferred arrangement of a compressor according to the invention in longitudinal section (a) and a detail of a connection between a force transmission element and a supporting element according to the second preferred arrangement in a sectional view.
Figure 8B:
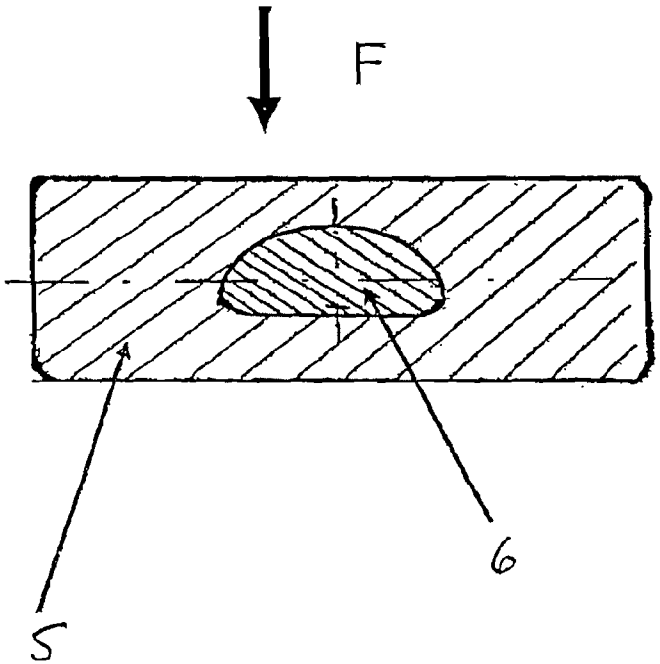

In an alternative, second preferred arrangement, which is shown in FIGS. 8*a* and 8*b*, the force transmission element 6 is rotatably mounted in the drive shaft 1 whilst the supporting element 5 is in non-rotatable engagement with the force transmission element 6. In the present preferred arrangement, the force transmission element 6 is a pin having a partly semi-elliptical cross-section. Of course a partly semi-circular cross-section, for example, would also be suitable. Said semi-elliptical cross-section is clearly shown especially in FIG. 8*b*. As already mentioned hereinbefore, the force transmission element 6 is, in modification of the first preferred arrangement, mounted in the drive shaft 1 so as to be rotatable about its longitudinal axis. The force transmission element 6 has a projection 23 which determines its position (especially in a radial direction) in the drive shaft 1. On that side of the force transmission element 6 which is remote from the supporting element 5, a securing element 24 ensures that the gas force support means 9 or, that is to say, the supporting element 5 and the force transmission element 6 is/are securely retained in the drive shaft 1. In this arrangement too, the drive pins 7 (not shown in FIGS. 8*a* and 8*b*) ensure the connection between the sliding sleeve 3 and the drive shaft 1 and the resultant force and/or torque transfer.

Figure 9:
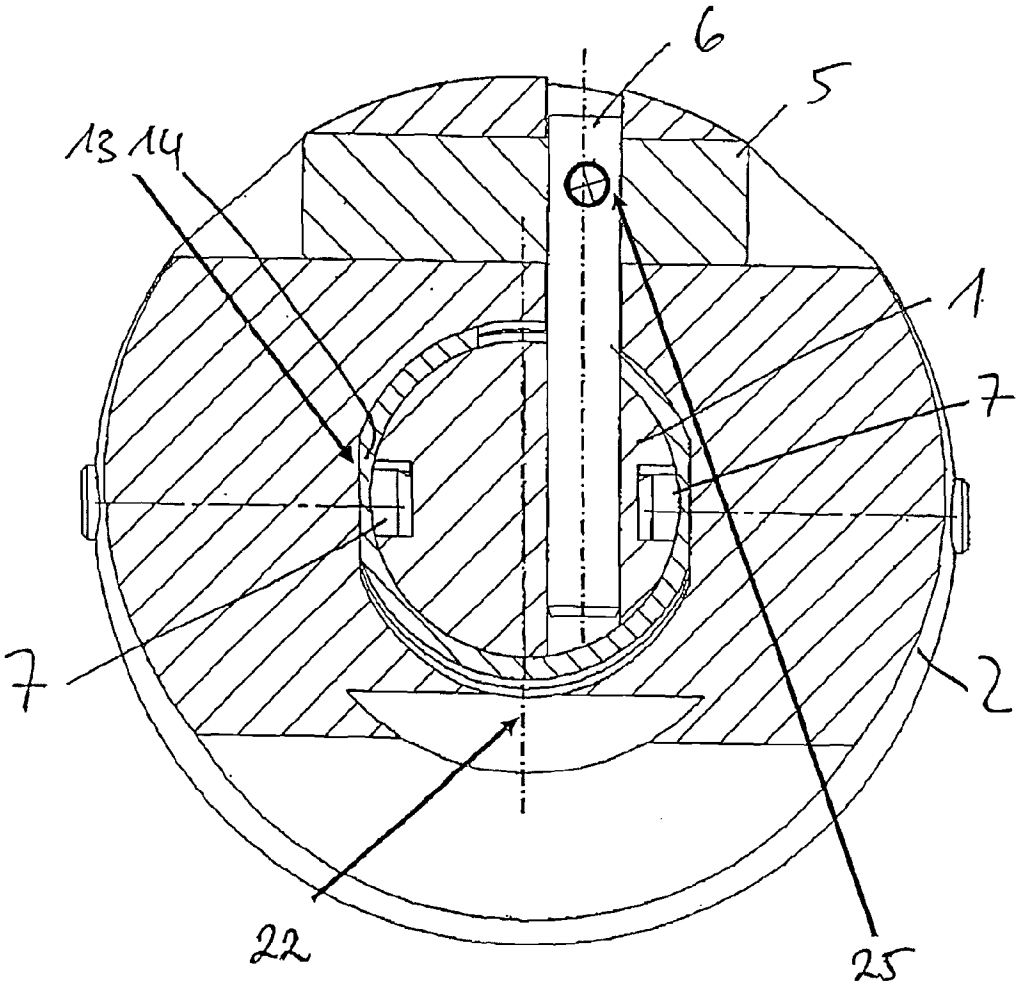
FIG. 9 shows, in a sectional view corresponding to FIG. 6, a third preferred arrangement of a tilt plate mechanism of a compressor according to the invention.
Figure 10:
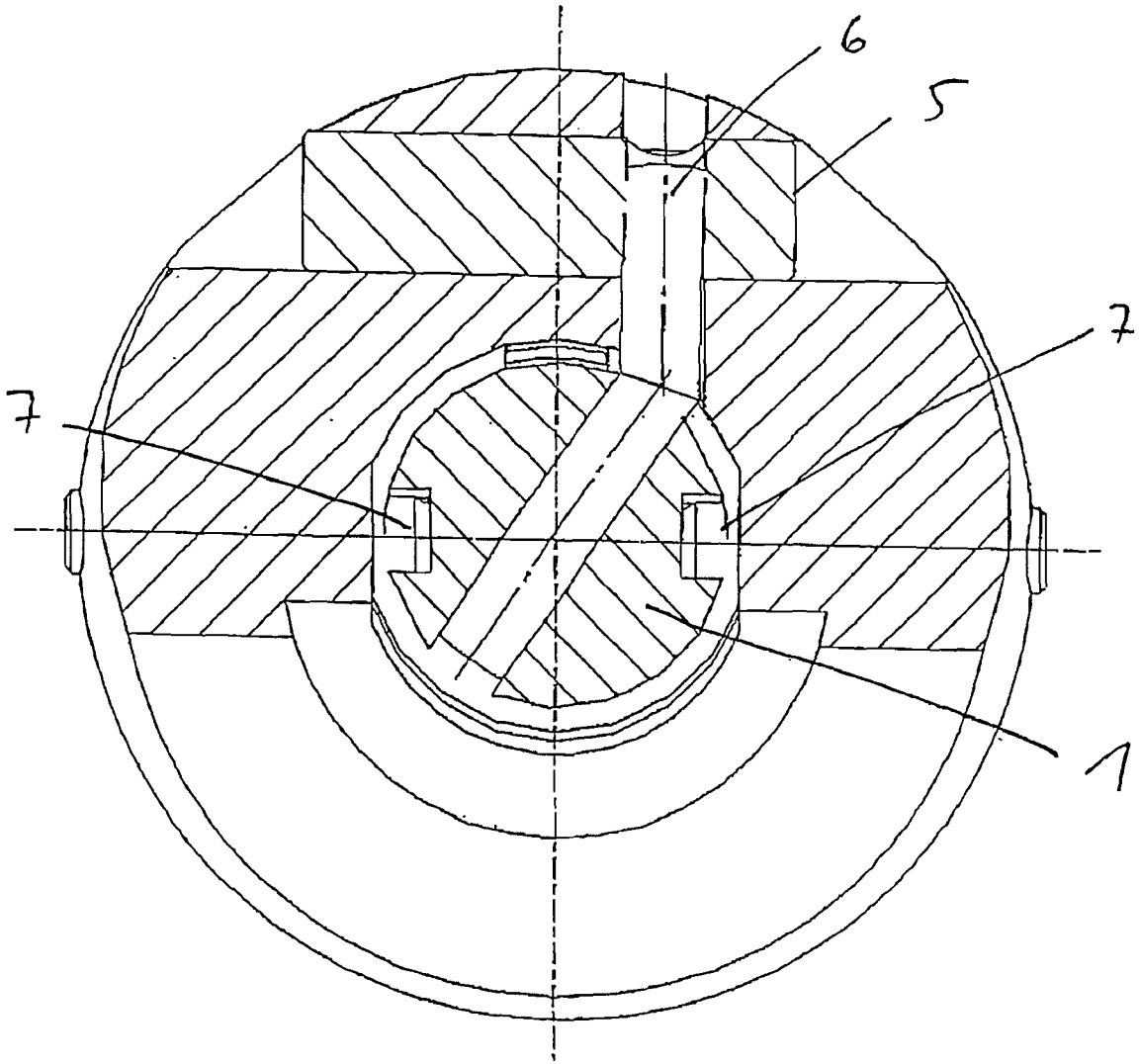
FIG. 10 shows, in a sectional view corresponding to FIGS. 6 and 9, a fourth preferred arrangement of a tilt plate mechanism.

FIGS. 9 and 10 contain two further preferred arrangements of a compressor according to the invention, with provision being made in the case of these two arrangements for the force transmission element 6 or, more precisely, the longitudinal axis thereof to be arranged offset with respect to the axis 22, which defines the direction of the torsional moment. In one of the possible arrangements thereof (cf. FIG. 9), the force transmission element 6 is eccentrically arranged relative to the drive shaft 1. The advantage that results therefrom is that the application point 25 for the resulting pressing force is located approximately on the axis of the force transmission element 6 and the axial force is transferred onto the force transmission element and the shaft 1 almost directly. This gives rise, in the best case, to a very small lever for the axial force and, as a result, a low torsional moment. Transfer of the torsional moment by way of the flattened regions is accordingly avoided to a very large extent and disadvantages such as additional friction, jamming or hysteresis are avoided. A further possible arrangement has a force transmission element 6 which is of angled shape and which has one portion extending parallel to the axis 22 of the torsional moment and one portion extending through that axis.

At this point details should again be given, by way of conclusion, of the advantages of the present invention. The imbalance due to the mounting and tilting of the tilt plate and of further parts associated with the mass-related properties of the tilt plate is very low. The mass moment of inertia of the tilt plate and of further parts which are to be associated with the mass-related properties of the tilt plate with regard to the tilting axis (moment of deviation) are optimised with regard to the space for installation, that is to say the compressor has down-regulating behaviour for high speeds of rotation and over the entire range of the angle of deflection of the tilt ring 2, that is to say especially also for small angles of deflection. The supporting element 5 is, as a result of appropriate formation, capable of taking up forces over a large area, which results in low Hertzian stress. The gas force support means 9 is free of torque transmitted between the shaft and the tilt plate so that over-determination of the force transmission function (which results in jamming) is avoided. Furthermore, the rigidity of the tilt ring 2 is optimised and articulated connection of the tilt ring 2 to the supporting element 5 is ensured with a low degree of surface contact pressure, that is to say low Hertzian stress.

As can be seen from, for example, FIG. 6*a*, the drive torque could be transferred from the force transmission element 6, firmly introduced into the drive shaft 1 with a press fit, to the supporting element 5 but not directly to the tilt ring 2 because, in a radial direction (relative to the drive or to the shaft), the force transmission element 6 is not in abutment (appropriately large recess in the tilt ring). In the radial direction of the drive mechanism/drive shaft (axial direction relative to the supporting element 5), the supporting element 5 has no abutment or no contact with the tilt ring 2. Therefore, the gas force support means 9, which includes the force transmission element 6 and the supporting element 5, cannot transfer the drive torque to the tilt ring 2. In the present invention, the gas forces are transferred through a bore in the tilt ring 2 to the cylindrical-pin-shaped supporting element 5 and then in turn from the bore in the supporting element 5 to the force transmission element 6. In each case the forces are transferred from a bore to a cylinder with a low degree of play. This results in substantially lower surface contact pressure (surface contact) and, as a result, lower wear than in the case of compressors according to the prior art.

A further substantial advantage is obtained with respect to the inertia-of-mass properties of the tilt ring 2 in combination with the supporting element 5. The supporting element 5 is so connected to the tilt plate that the mass forces due to the mass of the supporting element 5 relative to the tilt-producing articulation of the tilt ring 2 act directly on the tilt ring 2 (moment of deviation of the arrangement). This means that, in respect of the down-regulating moment, the supporting element can be treated in calculations as if it were rigidly connected to the tilt ring. This in turn leads to the crucial advantage that even a large recess for the supporting element is not disadvantageous if the supporting element fills it. This is of importance to the extent that in particular that mass of the tilt ring 2 which is far away from the tilt axis is a crucial component of the down-regulating moment of the tilt ring 2. This property of the tilting mechanism results in a relatively high moment of deviation (down-regulating moment) of the tilt ring 2 in combination with the supporting element 5, this still applying even for small angles of deviation of the tilt ring 2. Overall this makes possible very good down-regulating behaviour of the drive mechanism down to very small angles of deviation. A compressor according to the invention can moreover be manufactured economically because the deflection or tilting mechanism consists of relatively few parts. In addition, the components of the gas force support means 9 have a very simple geometry and few machining surfaces (for example, two cylinders, one of which is provided with a bore). The substantial components of the forces occurring in the tilt ring are transferred through the gas force support means 9 to the drive shaft and then, finally, are taken up in the shaft mounting.

In conclusion it should be noted that the supporting element 5 fills the recess in the tilt ring 2 to the greatest possible extent but, of course, ensuring that the supporting element 5 does not collide with the pistons at any possible angle of deflection of the tilt ring 2. The remaining recesses which are not filled by the supporting element 5 can be filled, for example by closure stoppers, so that the kinematics of the compressor are optimised.

Although the invention is described using arrangements having fixed combinations of features, it nevertheless also encompasses any further feasible advantageous combinations of those features, as are especially but not exhaustively mentioned in the subordinate claims. All features disclosed in the application documents are claimed as being important to the invention insofar as they are novel on their own or in combination compared with the prior art.

REFERENCE NUMERAL LIST

1 drive shaft
2 tilt ring
3 sliding sleeve
4 spring
5 supporting element
6 force transmission element
7 drive pin
8 bore in supporting element 5
9 gas force support means
10 bore
11 drive shaft axis
12 recess in drive shaft 1
13 flattened side of sliding sleeve 3
14 flattened region on tilt ring 2
15 groove
16 recess in sliding sleeve 3
17 recess in tilt ring 2
18 longitudinal slot
19, 20 arrow
21 tilt axis
22 axis of torsional moment
23 projection
24 securing element
25 application point
26 arrows

The invention claimed is:

1. An axial piston compressor for a motor vehicle air-conditioning system or other use, said compressor comprising:

a drive shaft;

tilt plate arranged to be variable in terms of an inclination thereof with respect to said drive shaft, said drive shaft being operative to drive said tilt plate in rotation;

at least one supporting element arranged at a spacing from said drive shaft and rotating together therewith, said tilt plate being connected to said at least one supporting element by being in articulated or other connection therewith;

a force transmission element which rotates together with said drive shaft and is fixed in the drive shaft in an approximately radial direction, said supporting element being arranged at a radially outer end of said force transmission element and the supporting element is rotatable around a longitudinal axis of the force transmission element;

a plurality of pistons, said pistons in each case having an articulated arrangement with which said tilt plate is in sliding engagement, wherein said force transmission element is in a connection selected from the group consisting of rotatable articulated connection, radially displaceable articulated connection, and rotatable and radially displaceable articulated connection with said supporting element; and said supporting element and said force transmission element form an approximately T-shaped gas force support means for transmission of gas forces transmitted by the pistons to the tilt plate further to the drive shaft.

2. A compressor according to claim 1, wherein said force transmission element has a connection to said drive shaft selected from the group consisting of a non-rotatable connection, a radially non-displaceable connection, and a non-rotatable and radially non-displaceable connection.

3. A compressor according to claim 1, wherein both said force transmission element and said supporting element comprise cylindrical pins.

4. A compressor according to claim 1, wherein said supporting element has a recess or bore in which said force transmission element engages.

5. A compressor according to claim 1, wherein said supporting element is mounted in said tilt plate in a cylindrical recess or bore which extends perpendicular to an axis of said drive shaft.

6. A compressor according to claim 1, wherein said supporting element and said force transmission element serve substantially only for providing the pistons with axial support or for support for a gas force, whereas independent thereof an articulated connection, or other arrangement between said drive shaft and said tilt plate serves substantially only for torque transfer.

7. A compressor according to claim 1, wherein said tilt plate is pivotally mounted on a sliding sleeve mounted so as to be axially displaceable along said drive shaft, said tilt plate being connected by way of drive pins to element(s) selected from the group consisting of said sliding sleeve, said drive shaft, and said sliding sleeve and said drive shaft.

8. A compressor according to claim 7, wherein said drive pins are introduced into an element selected from the group consisting of said sliding sleeve and said tilt plate with a press fit.

9. A compressor according to claim 7, wherein an arrangement selected from the group consisting of a supporting arrangement, an at least one cylindrical-pin-like element supporting arrangement, supporting surfaces, contact surfaces, and supporting and contacting surfaces are provided between said sliding sleeve and said tilt plate to provide support in relation to a torsional moment applied in a region of said drive shaft.

10. A compressor according to claim 1, wherein said force transmission element or the longitudinal axis thereof is arranged offset relative to an axis selected from the group consisting of the torque axis, an axis of the torsional moment, an axis of said drive shaft, a torque axis and the axis of the torsional moment, and a torque axis and the axis of the drive shaft.

11. A compressor according to claim 1, wherein element(s) selected from the group consisting of said supporting element, said force transmission element, and said supporting element and said force transmission element is/are formed of a plurality of parts.

12. A compressor according to claim 1, wherein said force transmission element has a shape selected from the group consisting of an angled shape, and an angled shape having one portion extending perpendicular to a tilt moment axis and one portion extending through the tilt moment axis.

13. A compressor according to claim 1, wherein said force transmission element is arranged eccentrically in said drive shaft.

14. A compressor according to claim 1, wherein said tilt plate is made of material selected from the group consisting of steel, brass and bronze.

15. A compressor according to claim 1, wherein said tilt plate has a low-wear coating.

16. A compressor according to claim 1, wherein said pistons are made of material selected from the group consisting of aluminum, an aluminum alloy, steel, and a steel alloy.

17. A compressor according to claim 1, wherein said supporting element has a barrel-shape with a diameter that becomes narrower from a middle of said barrel towards ends of said barrel.

18. An axial piston compressor for a motor vehicle air-conditioning system or other use, said compressor comprising:

a drive shaft;

tilt plate arranged to be variable in terms of an inclination thereof with respect to said drive shaft, said drive shaft being operative to drive said tilt plate in rotation;

at least one supporting element arranged at a spacing from said drive shaft and rotating together therewith, said tilt plate being connected to said at least one supporting element by being in articulated or other connection therewith;

a force transmission element which rotates together with said drive shaft and is fixed in the drive shaft in an approximately radial direction, said supporting element being arranged at a radially outer end of said force transmission element and the supporting element is rotatable around a longitudinal axis of the force transmission element;

a plurality of pistons, said pistons in each case having an articulated arrangement with which said tilt plate is in sliding engagement, wherein said force transmission element is in a connection selected from the group consisting of rotatable articulated connection, radially displaceable articulated connection, and rotatable and radially displaceable articulated connection with said supporting element; and said force transmission element is rotatably mounted in said drive shaft, whereas said supporting element is in non-rotatable engagement with said force transmission element.

19. An axial piston compressor for a motor vehicle air-conditioning system or other use, said compressor comprising:

a drive shaft;

tilt plate arranged to be variable in terms of an inclination thereof with respect to said drive shaft, said drive shaft being operative to drive said tilt plate in rotation;

at least one supporting element arranged at a spacing from said drive shaft and rotating together therewith, said tilt plate being connected to said at least one supporting element by being in articulated or other connection therewith;

a force transmission element which rotates together with said drive shaft and is fixed in the drive shaft in an approximately radial direction, said supporting element being arranged at a radially outer end of said force transmission element and the supporting element is rotatable around a longitudinal axis of the force transmission element;

a plurality of pistons, said pistons in each case having an articulated arrangement with which said tilt plate is in sliding engagement, wherein said force transmission element is in a connection selected from the group consisting of rotatable articulated connection, radially displaceable articulated connection, and rotatable and radially displaceable articulated connection with said supporting element; and said force transmission element is a pin having a shape selected from the group consisting of an at least partly approximately semi-circular cross-section, and an at least partly approximately semi-elliptical cross-section.

20. An axial piston compressor for a motor vehicle air-conditioning system or other use, said compressor comprising:

a drive shaft;

tilt plate arranged to be variable in terms of an inclination thereof with respect to said drive shaft, said drive shaft being operative to drive said tilt plate in rotation;

at least one supporting element arranged at a spacing from said drive shaft and rotating together therewith, said tilt plate being connected to said at least one supporting element by being in articulated or other connection therewith;

a force transmission element which rotates together with said drive shaft and is fixed in the drive shaft in an approximately radial direction, said supporting element being arranged at a radially outer end of said force transmission element and the supporting element is rotatable around a longitudinal axis of the force transmission element;

a plurality of pistons, said pistons in each case having an articulated arrangement with which said tilt plate is in sliding engagement, wherein said force transmission element is in a connection selected from the group consisting of rotatable articulated connection, radially displaceable articulated connection, and rotatable and radially displaceable articulated connection with said supporting element;

said tilt plate is pivotally mounted on a sliding sleeve mounted so as to be axially displaceable along said drive shaft, said tilt plate being connected by way of drive pins to element(s) selected from the group consisting of said sliding sleeve, said drive shaft, and said sliding sleeve and said drive shaft; and said drive pins project into a recess or groove in said drive shaft.

21. An axial piston compressor for a motor vehicle air-conditioning system or other use, said compressor comprising:

a drive shaft;

tilt plate arranged to be variable in terms of an inclination thereof with respect to said drive shaft, said drive shaft being operative to drive said tilt plate in rotation;

at least one supporting element arranged at a spacing from said drive shaft and rotating together therewith, said tilt plate being connected to said at least one supporting element by being in articulated or other connection therewith;

a force transmission element which rotates together with said drive shaft and is fixed in the drive shaft in an approximately radial direction, said supporting element being arranged at a radially outer end of said force transmission element and the supporting element is rotatable around a longitudinal axis of the force transmission element;

a plurality of pistons, said pistons in each case having an articulated arrangement with which said tilt plate is in sliding engagement, wherein said force transmission element is in a connection selected from the group consisting of rotatable articulated connection, radially displaceable articulated connection, and rotatable and radially displaceable articulated connection with said supporting element;

said tilt plate is pivotally mounted on a sliding sleeve mounted so as to be axially displaceable along said drive shaft, said tilt plate being connected by way of drive pins to element(s) selected from the group consisting of said sliding sleeve, said drive shaft, and said sliding sleeve and said drive shaft; and a feather key or other connecting element is arranged between said drive shaft and said sliding sleeve, which connecting element allows transfer of forces and moments in a radial direction and is mounted in an axially displaceable manner on said drive shaft.

22. An axial piston compressor for a motor vehicle air-conditioning system or other use, said compressor comprising:

a drive shaft;

tilt plate arranged to be variable in terms of an inclination thereof with respect to said drive shaft, said drive shaft being operative to drive said tilt plate in rotation;

at least one supporting element arranged at a spacing from said drive shaft and rotating together therewith, said tilt plate being connected to said at least one supporting element by being in articulated or other connection therewith;

a force transmission element which rotates together with said drive shaft and is fixed in the drive shaft in an approximately radial direction, said supporting element being arranged at a radially outer end of said force transmission element and the supporting element is rotatable around a longitudinal axis of the force transmission element;

a plurality of pistons, said pistons in each case having an articulated arrangement with which said tilt plate is in sliding engagement, wherein said force transmission element is in a connection selected from the group consisting of rotatable articulated connection, radially displaceable articulated connection, and rotatable and radially displaceable articulated connection with said supporting element;

said tilt plate is pivotally mounted on a sliding sleeve mounted so as to be axially displaceable along said drive shaft, said tilt plate being connected by way of drive pins to element(s) selected from the group consisting of said sliding sleeve, said drive shaft, and said sliding sleeve and said drive shaft; and an end of said force transmission element which is remote from said supporting element projects through said drive shaft and into a longitudinal slot in said sliding sleeve in such a way that drive torque is transmitted from said drive shaft to said sliding sleeve by the end of said force transmission element which is remote from said supporting element.

23. A compressor according to claim 5, wherein regions of the bore or other recess in said tilt plate which are not filled by said supporting element are substantially filled or closed by a closure element(s) or other compensating weight.

* * * * *